United States Patent [19]

May

[11] Patent Number: 4,519,366

[45] Date of Patent: May 28, 1985

[54] METHOD AND APPARATUS FOR CONTROLLING THE COMPOSITION OF THE COMBUSTION CHARGE IN INTERNAL COMBUSTION ENGINES

[76] Inventor: Michael G. May, Bel Air, CH-1180 Rolle, Switzerland

[21] Appl. No.: 478,567

[22] Filed: Mar. 24, 1983

[30] Foreign Application Priority Data

Mar. 24, 1982 [DE] Fed. Rep. of Germany ..... 3210810

[51] Int. Cl.[3] ..... F02D 35/02

[52] U.S. Cl. ..... 123/435; 123/568

[58] Field of Search ..... 123/425, 435, 568

[56] References Cited

U.S. PATENT DOCUMENTS

| | | | |
|---|---|---|---|
| 4,161,162 | 7/1979 | Latsch et al. | 123/435 |
| 4,314,534 | 2/1982 | Nakajima et al. | 123/435 X |
| 4,364,353 | 2/1982 | Fiala | 123/435 X |
| 4,417,556 | 11/1983 | Latsch | 123/435 X |
| 4,463,729 | 8/1984 | Bullis et al. | 123/435 X |

FOREIGN PATENT DOCUMENTS

| | | | |
|---|---|---|---|
| 2601871 | 8/1976 | Fed. Rep. of Germany | 123/435 |
| 2823005 | 12/1978 | Fed. Rep. of Germany | 123/435 |

*Primary Examiner*—Parshotam S. Lall
*Assistant Examiner*—W. R. Wolfe
*Attorney, Agent, or Firm*—Edwin E. Greigg

[57] ABSTRACT

A method is proposed for controlling the composition of the charges to be combusted in an internal combustion engine with externally supplied ignition, the charges comprising gas which contains oxygen, and a fuel. In order to automatically adjust the charge composition in at least one operating range, an event caused by the given combustion of the charge is ascertained in at least one combustion chamber in terms of at which crankshaft angle or the like (Y value) a predetermined status of this event is attained during the given charge combustion. The scattering of this Y value is continuously regulated to a set-point scattering value by means of adjusting the charge composition.

31 Claims, 3 Drawing Figures

METHOD AND APPARATUS FOR CONTROLLING THE COMPOSITION OF THE COMBUSTION CHARGE IN INTERNAL COMBUSTION ENGINES

BACKGROUND OF THE INVENTION

The invention relates to a method and apparatus as generally described hereinafter for controlling the combustion charge in internal combustion engines generally having externally supplied ignition.

In particular the invention is applicable to internal combustion engines with externally supplied ignition of various types, for instance 2-stroke Otto engines, 4-stroke Otto engines, multiple-fuel engines, piston engines, rotary-piston engines or the like. The invention can similarly be used not only in carburetor-type internal combustion engines but also in those provided with fuel injection or in butane gas or LPG engines with externally supplied ignition. The external ignition can preferably be effected by spark plugs, and in some cases by glow plugs as well.

As is well known, it is very important for the composition of the combustion charge which is to be combusted in a combustion chamber or chambers to be adapted as favorably as possible to given operating conditions. This combustion charge is a mixture of fuel and of gas which contains oxygen, in particular a fuel-air mixture; in many cases, the exhaust gas is added to this mixture to dilute the combustion charge. If the mixture is too rich for a given operating condition, the fuel consumption is unnecessarily high, and in such cases the emission of toxic exhaust gas components is also undesirably high. If the mixture (that is, the combustion charge) is set too lean, then once again the figures for the emission of toxic exhaust gas components increase, fuel consumption increases, and engine operation becomes faulty because of misfiring or retarded charge combustion. Numerous provisions are known for automatically adapting the combustion charge composition during operation to given operating conditions and also to conditions in the ambient atmosphere (such as air pressure, temperature and so forth). However, these provisions, if they are capable of favorably adapting the charge composition to prevailing operating parameters, are quite expensive and require numerous sensors and complicated systems for open- and closed-loop control.

The term "composition of the combustion charge" is intended to encompass both the case where the charge is formed outside the combustion chamber, whether with carburetors or by injection of fuel into the intake system, and the case where the charge is first formed in the combustion chamber by the injection of fuel into it.

OBJECT AND SUMMARY OF THE INVENTION

It is the object of the invention to create a method of the general type defined hereinafter, such as to enable the automatic setting and adjustment of the combustion charge composition in a relatively simple manner over at least a portion of the operating range of the engine, preferably over a wide operating range, and in such a manner that the fuel consumption is reduced and/or the emission of toxic exhaust gas components is decreased.

It is a further object in accordance with the invention to provide an apparatus for implementing the method for controlling the combustion charge in the internal combustion engine.

The invention is based on the following concept. Let it be assumed that the internal combustion engine is operating at a specific operating point of its partial-load range under constant operating conditions. If the charge—that is, the mixture being combusted—is set too rich, then the sequential combustions of the charge in the given combustion chamber take place with only a slight scattering in the course of combustion. If on the other hand the charge composition, or combustion mixture, is set too lean, then a relatively wide scattering in the course of sequential charge combustions occurs. Accordingly, at this operating point of the internal combustion engine there is a set-point value for the scattering in the combustion course of sequential charge combustions at which the combustion charge composition is practically optimal in terms of the lowest possible specific fuel consumption and/or the least possible emission of toxic exhaust gas components. If this set-point value for scattering is regulated at this operating point of the engine by means of a variation of the combustion charge composition, then an approximately optimal composition of the charge will be continuously established by regulation at this particular operating point. By a variation of the charge combustion is meant a positive control deviation, or in other words if with an excessively rich mixture the scattering of the combustion course of sequential charge combustions is increased up to the previously ascertained optimal set-point value for scattering by reducing the proportion of fuel in the mixture being combusted, or on the other hand if with an excessively lean mixture and a consequently excessively wide scattering, the scattering of the combustion courses of sequential charge combustions is reduced down to the set-point value for scattering by increasing the proportion of fuel in the mixture.

This regulation of the scattering can be accomplished not only for one operating point of the engine, but instead over a wide, partial-load range of the engine, or in some cases even at full load and/or idling and/or overrunning (if combustion of the combustion charge is still occurring at all during overrunning). It is possible, too, for the set-point value for scattering which has been ascertained and established as favorable for one operating point to be used without changing it over a wide partial-load range, or in some cases over the entire partial-load range—that is, this set-point value can be constant, and in some cases it can be used even in other operating ranges of the engine such as those listed above. However, in many cases it is useful or necessary for this set-point scattering value to be adjusted in a predetermined manner in accordance with at least one operating parameter of the engine, such as rpm and/or load and/or air pressure and/or air temperature and the like; for example, this value may be adjusted on a sliding scale in accordance with at least one operating parameter.

The adjustment of the combustion charge composition in accordance with the control deviation of the scattering may be effected in various ways. For instance, the combustion charge composition may be established upon injection of the fuel by adjusting the injection quantity at that time, or by adjustment in the carburetor, affecting the mixture composition, in the case of engines employing carburetors. Since suitable means for adjusting the combustion charge composition are known per se, they need not be described further here.

In internal combustion engines which have multiple combustion chambers, that is, in multi-cylinder engines, it is generally completely sufficient to ascertain the scattering of an event caused by the combustion of the charge at a given time, e.g., a crankshaft angle or the like, hereinafter called a Y value, for only a single combustion chamber and on the basis of this to influence the combustion charge composition for all the combustion chambers. However, it is also possible to adjust the charge composition for each individual combustion chamber, or for two or more groups of combustion chambers, separately, in order to regulate the scattering. In the latter case, in an engine with multiple cylinders, each cylinder may be provided by way of example with its own means for ascertaining the predetermined status of the particular event; for instance, each cylinder may have a flame front sensor, to be discussed in greater detail below, or some other suitable sensing means. It may then be provided, for instance, that the combustion charge composition be adjustable for each cylinder individually, independently of the other cylinders, by means of the associated flame front sensor and an associated regulating means for regulating the set-point scattering value for that cylinder; or each cylinder may have its own carburetor; or in the case of electromagnetically actuatable injection valves, each injection valve may be triggerable independently of the others by means of the regulating means associated with the cylinder associated with that injection valve. In order to simplify the regulating means, it may also be provided that these means share a common computer or the like, triggered via a multiplexer circuit controlled by the engine in synchronism with the engine speed, wherein the computer cyclically calculates the adjustments of the charge compositions for all the cylinders individually.

If it is also desired to regulate the K-F coincidence of piston travel and flame front arrival, as described for example in my co-pending U.S. application Ser. No. 312,481 now Pat. No. 4,465,064, detail below, then the computer can also perform the necessary calculations therefor; in these described examples of the independent adjustment of the charge of each cylinder or each group of cylinders, the K-F coincidence also can advantageously be regulated for each cylinder or each group of cylinders independently of the others. Alternatively, it is also possible to divide, for example, the four cylinders into two groups of two cylinders each and to adjust the composition of the combustion charge for each such group independently of the other group. In that case it is sufficient to assign a flame front sensor to only one cylinder of each of the two groups. Or it can also be provided that at least two cylinders of the engine or of the given cylinder group be assigned flame front sensors, or the like, wherein the charge composition for all the cylinders of the engine or of the given cylinder group will be identical, and that the signals provided by the flame front sensors are evaluated in common for the purpose of regulating the set-point scattering value.

The invention is remarkably well suited for internal combustion engines for ground vehicles, such as passenger vehicles, trucks, motorcycles and the like, having severely fluctuating operating parameters; however, the invention is also advantageously applicable in other ways, for instance in motors for aircraft and water craft or in stationary motors and the like.

A preferred embodiment of the invention is a four-stroke Otto engine, but as noted above the information is not restricted to this application.

The event occurring during a given charge combustion and upon which a predetermined state is ascertained in accordance with the crankshaft angle or the like (that is, the Y value) may be of various kinds. In a preferred exemplary embodiment of the invention, this predetermined state is defined as the arrival of the flame front of the charge being combusted at a predetermined location in the associated combustion chamber. The arrival may be ascertained by means of a flame front sensor, known per se, which responds for example to the ionization of the gas located in the combustion chamber. By way of example the sensor may have two electrodes connected to a constant direct voltage; as soon as the flame front arrives at the sensor location an electrical current appears between the two electrodes because of the pronounced ionization of the gas caused thereby.

Another form of embodiment of the invention, which is efficacious in many applications, provides that the event which is ascertained in terms of its scattering is the occurrence of a pressure maximum for the charge combustion then occurring in the combustion chamber. Measuring the pressure maximum in accordance with the crankshaft angle is known per se. For example, a piezoelectric pressure sensor may be associated with the combustion chamber, and its output signal, which is proportional to the pressure, is differentiated in order to ascertain the pressure maximum.

Yet another embodiment which may be provided in some cases is that the event ascertained in terms of its scattering is the occurrence of the maximum intensity of the light as a given charge is being combusted. In that case, a photosensitive sensor is associated with the combustion chamber which is disposed either inside or outside the combustion chamber behind a transparent window of the combustion chamber, and its output signal, which depends on the intensity of the light, can similarly be differentiated, for example, in order to ascertain the maximum intensity.

Also, it is conceivable that other events associated with the course of combustion can be used for adjusting the combustion charge composition in accordance with the invention by means of regulating the scattering of their predetermined status. One example proposes the variation in the angular speed of the crankshaft, such as occurs during every combustion process. If this variation in the angular speed is measured with sensitive instruments, which is possible, then greater or lesser scattering can again be ascertained, again by differentiation, for example, and used for the regulation of the scattering in accordance with the invention.

Instead of the crankshaft angle, other variables which are associated with the position of the piston of a given combustion chamber during the combustion of the charge and at which the predetermined status of the particular event in the course of combustion occurs may also be provided as the Y value; for example, the angle of rotation of the camshaft in valve-controlled engines, the position of the associated reciprocating or rotating piston directly, and so forth.

Further, it is sufficient and advantageous in many cases if the regulation of the scattering of the Y value is performed only in one or more operating ranges of the engine and is suppressed in at least one other operating range. To this end, it may preferably be provided that this regulation in the scattering of the Y value be made inoperative at full load of the engine and/or during overrunning and/or in a range of relatively low partial load and/or during idling, and for charge compositions to be effected in these operating ranges in any desired manner that is known per se.

In the case where the arrival of the flame front at a predetermined location in the combustion chamber is sensed, it may efficaciously be provided that this predetermined location can be reached by the flame front only following top dead center of the piston during the combustion stroke, and preferably not until at least 50–90% of the charge at that time has already been combusted.

The formation of the scattering of the Y value may be effected in various ways. In a preferred form of embodiment it is provided that the difference between two Y values occurring one shortly after the other and preferably one immediately after the other be ascertained as an actual scattering value. It is also possible to form an actual scattering value of this kind from more than two Y values, for instance 5 to 10 values and preferably approximately 10 Y values and/or not to use every Y value for ascertaining scattering but rather only every nth Y value, for example, where n is an integer greater than 1; for instance, every other Y value in sequence may be used. In the case of a multi-cylinder engine, the Y values serving to form a control deviation may advantageously be obtained from charge combustions of the same combustion chamber of the engine; however, it is also possible in some cases to ascertain Y values from charge combustions in several combustion chambers and to ascertain actual scattering values common to all of them on that basis.

In a preferred method, every actual scattering value is compared with the set-point scattering value, and the control deviation thus determined is used for regulating the combustion charge composition.

Another method is to form an average scattering value from a plurality of final actual scattering values in sequence, to compare it with the set-point scattering value in order to form the control deviation at that time, and to use this control deviation in order to regulate the combustion charge composition.

In some cases it may also advantageously be provided that the actual scattering values be temporarily stored and then used in a manner which fades over time for ascertaining the control deviation; in that case it may be provided that they be stored in a memory in a manner that fades over time (being stored, for instance, in a resistor-capacitor element), and that the instantaneous memory contents at a given time be compared with the set-point scattering value to form the control deviation. Moreover, these values may instead be stored in a ring counter acting as a memory and shifted in this counter with each new entry of information, the memory addresses then being evaluated in a weighted manner to calculate the actual scattering; that is, the values are assigned less and less weight, the farther they are from the memory input.

In many cases it may also advantageously be provided that every actual scattering value be compared with the set-point scattering value, the deviation between the two values formed, and the combustion charged composition adjusted only if at least a predetermined number of sequentially stored control deviation values deviate in the same direction from the set-point scattering value. This predetermined number is preferably two or three. As a result, the stability of regulation is increased, and incidental fluctuations are suppressed to an increased extent.

It is possible for the combustion charge composition to be adjusted, in the appropriate operating range, exclusively by using the scattering regulation according to the invention. In order to increase the speed of adjustment of the charge composition still further, or to be able to adjust the charge composition still more precisely and quickly, it may be provided in accordance with a preferred form of embodiment of the invention that the regulation of the scattering be used only for fine adjustment of the charge composition, and that a rough adjustment be superimposed on this fine adjustment, the rough adjustment being performed in a conventional manner by adjusting the carburetor, the family of injection quantity characteristics or the like. The quantity of exhaust gas recirculation, if provided, may also be varied for the purpose of effecting regulation according to the invention.

In the case where the arrival of the flame front of the charge being combusted at a given time at a predetermined location of the combustion chamber is sensed, this sensing of the arrival of the flame front can additionally be used for automatically adjusting the instant of ignition by regulating the K-F coincidence. This regulation is then effected in addition to the regulation of the Y value scattering. By means of this adjustment of the instant of ignition, the average value of the Y value scattering at a given time is thus regulated to a predetermined crankshaft angle or the like, which corresponds to the K distance, that is, the distance traveled by the piston from its top position during a given charge combustion. More specifically, the instant of ignition of the charge in the combustion chamber is automatically adjusted at a given time in such a manner that when the piston head, beginning at its top dead center position, has traveled a predetermined distance—the K distance—toward its bottom dead center position during the given charge combustion, the flame-front of the combusting charge has in the meantime approximately attained a predetermined location—the F position—in the combustion chamber, so that the arrival of the flame-front at the F location approximately coincides with the arrival of the piston head at the end of the K distance, and further the flame-front of the flame caused by the spark plug in order to combust the charge does not attain the F location until the predominant part of the charge has already combusted. As a result, both the combustion charge composition and the instant of ignition are continuously adjusted automatically, each to optimal values. In such a further embodiment revealed, e.g., in my U.S. Pat. No. 4,465,046, issued Aug. 14, 1984, of the invention, the presence of a flame front sensor in the associated combustion chamber of the engine can additionally be used not only for regulating the scattering of the arrival of the flame front but also for automatically adjusting the instant of ignition, using the same flame front sensor, which reduces production costs.

The invention will be better understood and further objects and advantages thereof will become more apparent from the ensuing detailed description of a preferred exemplary embodiment taken in conjunction with the drawings.

DESCRIPTION OF THE PREFERRED EMBODIMENT

Figure 1:
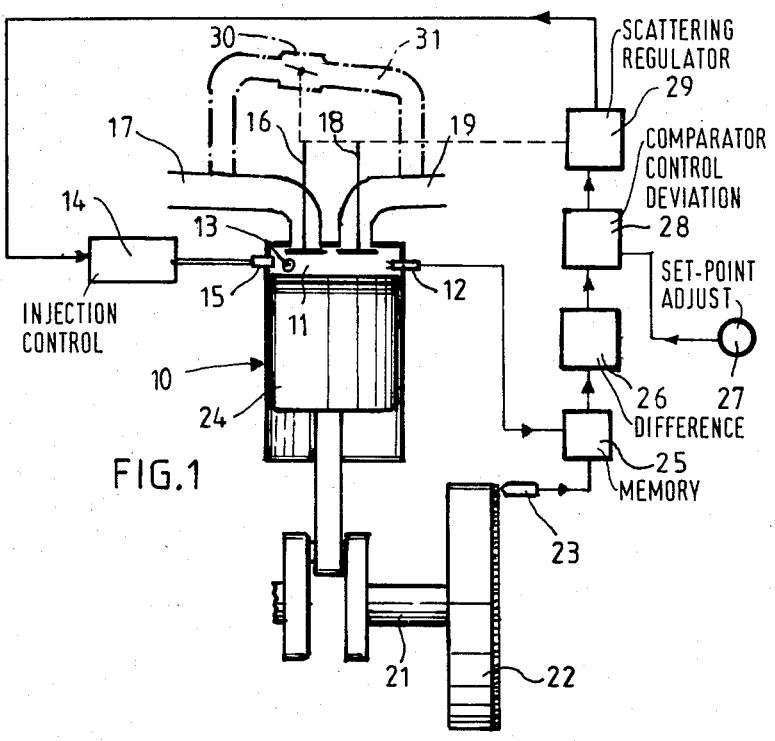
FIG. 1 is a schematic sectional view and a block diagram showing an internal combustion engine with externally supplied ignition, having a means of scattering regulation according to the invention.

In FIG. 1, a cylinder of a four-stroke internal combustion engine with externally supplied ignition is shown at 10 in a schematic, sectional view, and a flame front sensor 12 is disposed in the wall of the combustion chamber 11 for sensing the arrival of the charge ignited at a given time by the spark plug 13. The inlet valve is marked 16, the intake tube 17, the outlet valve 18 and the exhaust pipe 19, and the fuel is injected into the combustion chamber 11 by means of an injection device 14 and an injection nozzle 15. The flame front sensor 12 signals a given arrival of the flame front by means of a voltage drop caused by the ion current effected by that flame front. Furthermore, the rotational angle of the crankshaft 21 at the crankshaft plate 22 is sensed during each combustion stroke by means of a sensor 23, and the crankshaft angle at which the particular arrival of the flame front at the flame front sensor 12 occurs is fed, as a Y value (or an event as previously described), into a memory 25. The memory 25 stores the last two Y values sensed, for example, and feeds them to a differentiation member 26, which forms the absolute value of their difference, as an actual scattering value. A set-point adjusting member 27 is also present, which feeds a constant set-point scattering value, or a set-point scattering value which is adjustable in accordance with at least one operating parameter (as in FIG. 3, for instance), into a comparator-control deviation member 28, to which the output of the differentiation member 26, as the actual scattering value, is also fed. In the member 28, the difference between the set-point and the actual scattering values is formed in terms of magnitude and algebraic sign [+ or −] and fed as a control deviation into a scattering regulator 29, the output of which controls the injection device 14 for adjusting the fuel quantity to be injected at a given time, the adjustment being such as to effect a reduction in the control deviation of the scattering. If the actual scattering value is smaller than the set-point scattering value, this means that the charge contains too much fuel, and the fuel guantity is reduced accordingly; if the actual scattering value is larger than the set-point scattering value, the charge contains too little fuel and the fuel quantity is accordingly increased. A continuous regulation of the set-point scattering value thus takes place, as is shown in terms of one example in the diagram of FIG. 2.

Figure 2:
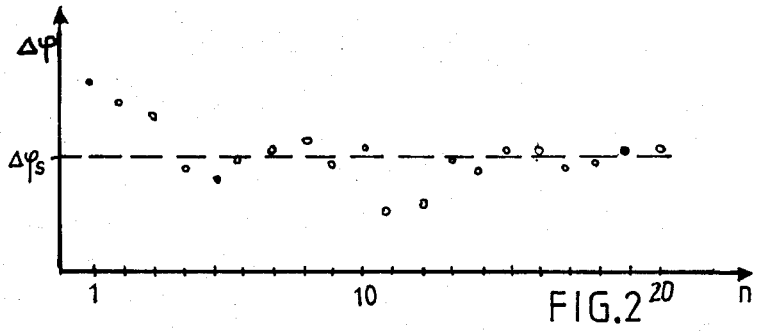
FIG. 2 is a diagram of one example of the scattering of actual scattering values about a set-point scattering value which is to be regulated.

In FIG. 2, the abscissa is numbered for sequentially ascertained actual scattering values 1, 2, 3 . . . n, and the ordinate corresponds to $\Delta\phi = Y_n - Y_{n+1}$ in crankshaft angle differences, where $Y_n$ is the Y value at the nth combustion stroke and $Y_{n+1}$ is the Y value at the (n+1)th combustion stroke. Assuming as an example that the instantaneously established set-point scattering value $\Delta\phi_s$ amounts to 25° of crankshaft angle difference, then as will be understood the charge composition is respectively varied such that the actual scattering values $\Delta\phi$ fluctuate about the set-point scattering value $\Delta\phi_s$. As a result, a practically continuously optimal charge composition is attained, and the set-point scattering value can be pre-specified such that the engine operates with practically minimal specific fuel consumption and/or with practically minimal toxic emissions values at a given operating point.

Instead of adjusting the injection quantity of the fuel for regulating scattering, it may also be provided that this be accomplished by controlling an exhaust gas recirculation system, indicated in FIG. 1 by dashed lines, by means of a throttle valve 30 that is adjustable by the output of the regulator 29. In this case, the charge composition is effected by adjusting the volume of the flow of exhaust gas recirculated from the exhaust gas conduit 19 via the line 31 into the intake tube 17. The increase in the exhaust gas quantity increases the actual value of scattering, while reducing the recirculated exhaust gas quantity decreases this scattering, so that it is again possible to regulate the set-point scattering value.

The measurement of the Y value may be accomplished in various ways. For example, the crankshaft plate 22 may carry a toothed segment, so that as each tooth passes the sensor 23 during the combustion stroke a pulse is emitted, and these pulses are counted in a counter, beginning for instance with 10° of crankshaft angle before top dead center of the piston 24 and continuing until the arrival of the flame front at the sensor 12, and then the contents of the counter are fed into the differentiation member 26 as the value $Y_n$, simultaneously resetting the counter back to zero, and the value $\Delta\phi + Y_{n-1} - Y_n$ is formed. Then, upon the next combustion stroke, the $Y_{n+1}$ value is fed into the differentiation member 26, and next, while the differentiation member is being reset to zero, the new scattering value $\Delta\phi = Y_n - Y_{n-1}$ is fed into the member 28 in order to form the new control deviation. This is repeated continuously in the appropriate operational range, and so the scattering of the Y values is continuously regulated to the set-point scattering value.

It is usually efficacious not to perform this regulation with a constant set-point scattering value but instead to adjust the set-point scattering value on a sliding scale in accordance with at least one operating parameter. One example of this is provided in the diagram of FIG. 3. Here the set-point scattering value $\Delta\phi_s$ is automatically adjusted in accordance with a performance graph ascertained experimentally for a particular engine, in accordance with the rpm of the engine and its average effective working pressure $P_{eff}$; the adjustment is preferably performed continuously. Each closed curve in FIG. 3 corresponds to one constant set-point scattering value. The set-point scattering value may in turn correspond to the set-point value for the scattering of two sequential Y values.

Figure 3:
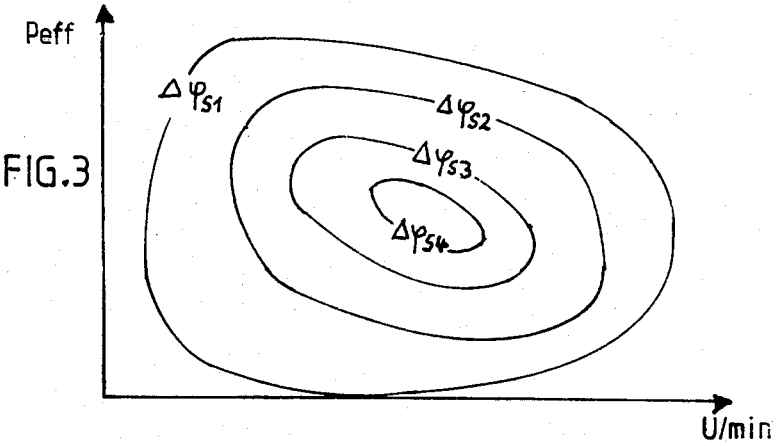
FIG. 3 is a performance graph, dependent on rpm and load, of set-point scattering values which can be pre-specified.

In the diagram of FIG. 3, the set-point scattering curves may by way of example correspond to the following set-point scattering values for crankshaft angle:

$\Delta\phi_{s1} = 15°, \Delta\phi_{s2} = 20°, \Delta\phi_{s3} = 25°, \Delta\phi_{s4} = 30°$.

It may also be provided that upon each new control deviation the combustion charge composition is varied either independently of or dependent on the magnitude of that control deviation, or that the charge composition is varied only if the absolute value of the control deviation exceeds a minimum value and/or if the last two control deviations at a given time have the same algebraic sign, that is, if they were both positive or both negative. It may also be provided that the combustion charge composition be varied to a greater extent, the more frequently one control deviation has the same algebraic sign as the control deviation preceding it.

Instead of forming the scattering value based on the last two Y values at a given time, it may also be provided that these values correspond to some other suitable scattering, such as an average value formed from a plurality of sequential actual scattering values, each actual scattering value being formed from two sequential Y values or from more than two sequential actual scattering values. The scattering may be formed, for instance, from the last j values for Y in accordance with the concepts of error computation, where j is an integer. If an arithmetic average is formed from j Y values, then the scattering may be the squared average of the individual deviations from the arithmetic average. A low value may efficaciously be seleced for j, such as $j=3$ or $j=4$.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for controlling the composition of a combustion charge in an internal combustion engine having externally supplied ignition, said charges comprising an oxygen infused gas and a fuel, and said engine including a crankshaft, at least one cylinder having a piston operatively connected to said crankshaft for reciprocal motion therein, a combustion chamber in which during each combustion cycle a combustion charge is progressively ignited beginning at an ignitor location within said chamber to cause said piston to move toward an extreme position, and the progressive ignition of said charge defining a flame-front which expands throughout said chamber from said ignition location, comprising:

detection means in proximity with said combustion chamber and said crankshaft for directly ascertaining events $\phi$ corresponding to combustion and crankshaft angle, means for storing a plurality of values of said events, means for determining the scattering value of said stored events $\phi$ for consecutive combustion charges, means providing a set-point value of a target scatter value of said events, comparison means for comparing said scatter value of said stored values with said set-point value, and regulating means responsive to said comparison means for adjusting the composition of said charge.

2. An apparatus as defined by claim 1, wherein said detecting means comprises a pressure sensor disposed in said combustion chamber, and said pressure sensor acts upon a means which signals the occurrence of the pressure maximum during a given charge combustion and ascertains said event at the instant of said given pressure maximum.

3. An apparatus as defined by claim 1, wherein said detecting means comprises means for recognizing the occurrence of the maximum in light intensity of said charge combusting at a given time.

4. An apparatus as defined by claim 1, wherein said detecting means comprises a flame-front sensor disposed in said combustion chamber.

5. An apparatus as defined by claim 4, wherein said flame-front sensor is the sensor of an adjusting device for adjusting the instant of ignition of said charges.

6. An apparatus as defined by one of the claims 1–3, comprising means for adjusting said set-point value in accordance with at least one operating parameter of the engine.

7. A method for controlling the composition of combustion charges in an internal combustion engine having externally-supplied ignition, said charges comprising an oxygen infused gas and a fuel, and said engine including a crankshaft, at least one cylinder having a piston operatively connected to said crankshaft for motion therein, a combustion chamber in which during each combustion cycle a combustion charge is progressively ignited beginning at an ignition location within said chamber to cause said piston to move towards an extreme position, and the progressive ignition of said charge defining a flame-front which expands throughout said chamber from said ignition location, comprising the steps of:

directly detecting in said chamber during at least one operating range of said engine an event in terms of a value $\phi$ caused by combustion of said charges related to said piston position at which a predetermined status of said events is attained, determining the scattering value of said events for consecutive combustion charges, and regulating said scattering value towards a set-point value of said scattering by adjusting the composition of said charge.

8. A method as defined by claim 7, wherein said regulating step is made inoperative at full load.

9. A method as defined by claim 7, wherein said regulation of the scattering of said value is used only for a fine adjustment of said charge composition, and a conventional rough adjustment of said charge composition is superimposed on said fine adjustment.

10. A method as defined by claim 7, wherein said adjustment of said charge composition is performed by adjusting the supply of fuel.

11. A method as defined by claim 7, further comprising the step of: adjusting the instant of ignition of said charge so that when said piston, beginning at its top dead center position, has traveled from its top position, a predetermined distance toward its bottom dead center position during a given charge combustion, and when said event of said combusting charge has approximately attained a predetermined state in said chamber.

12. A method as defined by claim 7, wherein said regulating step is made inoperative during overrunning.

13. A method as defined by claim 7, wherein said regulating step is made inoperative in a range of low partial load.

14. A method as defined by claim 7, wherein said regulating step is made inoperative during idling of the engine.

15. A method as defined by claim 7, wherein said adjustment of said charge composition is performed by adjusting the supply of air.

16. A method as defined by claim 7, wherein said adjustment of said charge is performed by adjusting the recirculation of exhaust gas.

17. A method as defined by claim 7, further comprising the step of: adjusting the instant of ignition of said charge when said piston, beginning at its top dead center position, has traveled from its top position, a predetermined distance toward its bottom dead center position during a given charge combustion, and when said flame-front of said combusting charge has approximately attained a predetermined location in said chamber, whereby the arrival of said flame-front at said location shall approximately coincide with the arrival of said piston at the end of said distance, and said flame-front does not attain said location until the predominant part of said charge is burning.

18. A method as defined by claim 7, wherein the difference between at least two values following closely one upon the other, preferably immediately following one another, is ascertained as an actual scattering.

19. A method as defined by claim 7, wherein an actual scattering is formed from more than two consecutive values for a given operating condition.

20. A method as defined by claim 18 or 19, wherein said actual scattering for a given operating condition is compared with said set-point scattering at that operating condition, and a control deviation is ascertained and used for regulating said scattering of said value.

21. A method as defined by claim 18 or 19, wherein each said actual scattering is compared with said set-point scattering and a control deviation is formed and stored in memory, and said charge composition is adjusted only at such a time as at least a predetermined number of sequentially stored control deviations deviate in the same direction from said set-point scattering.

22. A method as defined by claim 18 or 19, wherein an actual average value of said scattering is formed from a plurality of sequentially ascertained actual scatterings and is compared with said given set-point scattering for forming a control deviation, and said control deviation is used for regulating said scattering of said value.

23. A method as defined by claim 22, wherein said actual scattering is stored in a memory which fades with time, and this is used for forming the control deviation of said scattering of said value.

24. A method as defined by claim 7, wherein said events are defined by the arrival of the pressure maximum in said combustion chamber during a given charge combustion.

25. A method as defined by claim 7, wherein said events are defined by the occurrence of the maximum in the intensity of light in a charge combusting at a given time.

26. A method as defined by claim 7, wherein said events are defined by the arrival of said flame-front of said charge being combusted at a given time at a predetermined location of said combustion chamber.

27. A method as defined by claim 26, further comprising the steps of: sensing the arrival of said flame-front at a location of said combustion chamber during a normal course of combustion, and allowing said arrival to only follow top dead center of said piston during a combustion stroke, preferably not until at least 50–90% of the given charge is burning.

28. A method as defined by claim 26, further comprising the steps of: sensing the arrival of said flame-front at a location of said combustion chamber during a normal course of combustion, and allowing said arrival to only follow top dead center of said piston during a combustion stroke, preferably not until at least 50–90% of the given charge is burning.

29. A method as defined by claim 7, 26, 24, or 25, wherein said set-point scattering value is adjusted in accordance with at least one operating parameter of the engine.

30. A method as defined by claim 29, wherein said set-point scattering is adjusted in accordance with the load of the engine.

31. A method as defined by claim 29, wherein said set-point scattering is adjusted in accordance with the rpm of the engine.

* * * * *